United States Patent [19]

Blackburn et al.

[11] 4,292,077

[45] Sep. 29, 1981

[54] TITANIUM ALLOYS OF THE $TI_3AL$ TYPE

[75] Inventors: Martin J. Blackburn, Kensington; Michael P. Smith, Glastonbury, both of Conn.

[73] Assignee: United Technologies Corporation, Hartford, Conn.

[21] Appl. No.: 60,264

[22] Filed: Jul. 25, 1979

[51] Int. Cl.[3] ..... C22C 14/00; C21D 1/00

[52] U.S. Cl. ..... 75/175.5; 148/11.5 F; 148/12.7 B; 148/32.5; 148/133

[58] Field of Search ..... 75/175.5; 148/11.5 F, 148/12.7 B, 133, 32.5

[56] References Cited

U.S. PATENT DOCUMENTS

| | | | |
|---|---|---|---|
| 2,880,087 | 3/1959 | Jaffee | 75/175.5 |
| 2,880,088 | 3/1959 | Jaffee et al. | 75/175.5 |
| 2,881,105 | 4/1959 | Gullett | 75/175.5 X |
| 2,899,303 | 8/1959 | Busch et al. | 75/175.5 |
| 2,968,586 | 1/1961 | Vordahl | 148/133 |
| 3,156,590 | 11/1964 | Vordahl | 148/12.7 B |
| 3,169,085 | 2/1965 | Newman | 148/11.5 F |
| 3,194,693 | 7/1965 | Soltis | 75/175.5 X |
| 3,411,901 | 11/1968 | Winter | 75/175.5 |
| 3,986,868 | 10/1976 | Crossley | 75/175.5 |

FOREIGN PATENT DOCUMENTS

| | | | |
|---|---|---|---|
| 595980 | 4/1960 | Canada | 75/175.5 |
| 596202 | 4/1960 | Canada | 75/175.5 |

OTHER PUBLICATIONS

McAndrew et al., "Investigation of Ti-Al-Cb System . . . ", Wadd Tech. Rpt. 60-99, Apr. 1960, pp. iii, 15, 16.

"Development of Ti-Al-Cb Alloy For Use At 1200°-1800° F., Tech. Doc. Rpt.-ASD-TR-61-446, pp. 6-12.

"Development of Ti-Al-Cb Alloy For Use At 1200°-1800° F.", T.D.R.-ASD-TR-61-446-Part II, pp. 5,6,8.

"Research To Conduct . . . Investigation of Alloys", Tech. Report AFML-TR-78-18, Mar. 1978, pp.-selected pages.

*Primary Examiner*—L. Dewayne Rutledge
*Assistant Examiner*—W. G. Saba
*Attorney, Agent, or Firm*—C. G. Nessler

[57] ABSTRACT

Titanium-aluminum-niobium alloys having narrow and critical composition ranges are disclosed. The alloys have room temperature tensile elongations of 1.5% or greater and creep strength to density ratios better than certain nickel superalloys. Thus, they may replace other heavier base alloys in many applications up to 750° C. Aluminum content must be closely controlled as excess amount decreases ductility while insufficient amount decreases creep strength. Niobium content is also critical as excess amount adversely affects creep strength-to-density ratio while insufficient amount decreases ductility. And there is an important interrelationship between niobium and aluminum.

Disclosed are alloys having atomic percent compositions of 24-27 Al, 11-16 Nb, balance Ti; more preferred are alloys of 24.5-26 Al, 12-15 Nb, balance Ti. (Nominally, these alloys in weight percent are Ti-13/15Al-19.5/30Nb and Ti-13.5/15Al-25/28Nb.) Vanadium is uniquely found to be substitutional for niobium in the foregoing alloys in amounts up to 4 atomic percent, thereby reducing density and increasing strength-to-density ratio while maintaining properties. Mechanical properties are dependent on heat treatment. For the best combination of strength and ductility, the alloys are heated or forged above the beta transus and controllably cooled to produce a fine Widmanstatten microstructure.

7 Claims, 9 Drawing Figures

TITANIUM ALLOYS OF THE $Ti_3AL$ TYPE

The Government has rights in this invention pursuant to Contract F33615-75-C-1167, awarded by the Department of the Air Force.

BACKGROUND OF THE INVENTION

1. This invention relates to titanium base alloys of the $Ti_3Al$ (alpha two) type which are usable at elevated temperatures and have useful ductility at lower temperatures.

2. Titanium alloys have found wide use in gas turbines in recent years but they are limited in use to temperatures below 600° C. by decreasing strength. During the last twenty years there was considerable work on higher temperature alloys particularly those derived from the ordered alloys $Ti_3Al$ (alpha two phase) and TiAl (gamma phase). However, none of the prior alloys based on TiAl and $Ti_3Al$ has been found useful in engineering applications, mostly because the alloys which had strength did not have adequate low temperature ductility. Other factors limiting alloys' utility are lack of metallurgical stability, high density and lack of fabricability, (ability to be cast, forged, machined, etc.).

Presently, iron, nickel, and cobalt super alloys are used at temperatures beyond those at which titanium alloys are able to perform. To replace such alloys, of which nickel alloy INCO 713C is an example, new titanium alloys must have equal or better strength to density ratios. To be useful as engineering materials they also must have ductility at room and intermediate temperatures; that is, desirably at least 1.5% tensile elongation at room temperature and around 3% at 200°-400° C.

There has been further research on titanium aluminide alloys in the last few years, and this, coupled with improved tools and knowledge of metallurgy, has now produced new advances. In our copending application Ser. No. 060,265, filed July 25, 1979, we described new alloys of the TiAl type. We are now also able to disclose herein new alloys of the $Ti_3Al$ type. It is well appreciated by those skilled in the art that the two alloy types are quite metallurgically distinct and have dissimilar alloying characteristics (as in fact, a comparison of our applications will support).

For much background on the prior art in titanium aluminum alloys, we make reference, and incorporate, the Background in our aforementioned application. Of the references in our other application, Jaffee U.S. Pat. No. 2,880,087 is worth further note here. $Ti_3Al$ in weight percent is the alloy Ti-14AL1. Jaffee broadly discloses alloys of 8-34 weight percent aluminum containing from 0.5-50 percent columbium, vanadium, many other elements, and mixtures thereof, but no teaching is given on proportions of the elements V and Cb, nor of any particular criticality within the range. It will be seen below that such broadly comprised alloys are not of utility in engineered machines.

Winter in U.S. Pat. No. 3,411,901 discloses Ti-Al-Nb alloys, particularly those having by weight percent 10-30 Al, and 8 parts Nb for every 7 parts Al. Specific alloys range from Ti-12Al-12Nb to Ti-17.5Al-20 Nb. The alloy compositions taught by Winter are constrained, as the phase diagram, FIG. 1, of his patent indicates. The alloys fall along the line which includes the compositions $TiNbAl_3$ and $NbAl_3$, and define the particular relation of Nb and Al, which we have now discovered does not produce the best properties. While Winter discloses favorable 800° C. tensile elongations of about 5-15%, lower temperature ductilities are not disclosed. Additions of Si, Hf, Zr, and Sn are mentioned to improve workability and strength.

In the early 1960's McAndrew et al made reports entitled "Investigation of the Ti-Al-Cb System as a Source of Alloys for Use at 1200°-1800° F.". Among these reports are WADD 60-99 and ASD-TR-61-446, Parts I and II, published by the U.S. Air Force, Wright Paterson Air Force Base, Ohio. Initially a matrix of alloys was cast, containing by weight 5-15% Al and from 15-30% Cb in increments of 2.5%. The strong effect of Al was noted in all Cb contents, although this is not to say it was entirely consistent. In the second phase, sheet was made from scaled up heats of Ti-15Al-17.5Cb and Ti-10Al-15Cb to evaluate heat treat response and other behavior. Since none of the Ti-Al-Cb alloys were deemed to have adequate combination of properties, subsequent work evaluated improved purity (no strong effect found) and additions of 1-5% Zr, Hf and Sn. It was concluded that alloys of high Cb and Al content were preferred with quarternary additions of Hf and Zr. Also seen to be promising were Ti-12.5/15Al-22.5Cb-0.5/5(Hf/Zr/Sn). The third and final phase of the work included evaluation of Ti-12.5Al-35Cb and Ti-17.5Al-17.5Cb; but these alloys had negligible room temperature ductility. The most promising alloys were seen to be Ti-13Al-25Cb-5Hf-0.1C and Ti-15Al-22.5Cb-1Sn. Heat treatments and other processing were also reported on. Although still appearing foresighted in systematic pursuit of the Ti-Al-Cb system, McAndrew et al did not succeed in establishing for the Ti-Al-Cb system the optimum relationship of Al and Cb, although some of their test alloys came near to those which we will reveal below. The teaching of the McAndrew et al work is that there is no particularly promising Ti-Al-Cb alloy except those which contain 1-5% Hf/Zr/Sn. And of Ti-Al-Cb-Hf/Zr/Sn alloys, the teaching from the two aforementioned least unpromising alloys is that when Al is increased, Cb should be decreased.

Thus, it may be said first that the prior art reveals Ti-Al-Nb alloys in general and certain specific compositions. Among the various beta promoters there is no strong distinction especially insofar as providing advantage in a combination of low temperature ductility and creep resistance.

SUMMARY OF THE INVENTION

An object of the invention is to provide titanium alloys which have high strength to density ratios, which are usable at temperatures of 600° C. and above, and which have ductility at lower temperatures. A further object is to provide new alloys which are fabricable by current metal-working equipment and processes.

According to the invention, new alloys of the $Ti_3Al$ type are comprised of aluminum, niobium, and titanium. While alloys containing the aforementioned elements have been known previously, they did not meet the objects of the invention, and in fact, are not useful in an engineering sense. The compositional ranges we reveal here for alloys which are useful are quite narrow, as the change in properties is much more critically dependent on the precise composition than was known heretofore. According to the invention, alloys containing titanium, 24-27 atomic percent aluminum and 11-16 atomic percent niobium have good high temperature strength with low temperature ductility. (These alloys may be stated in nominal weight percent as Ti-13/15Al-18/28Nb.) More preferred is an alloy comprised by atomic percent of 24.5–26 Al and 12–15 Nb, balance titanium (or in weight percent, about Ti-13/15Al/-25/26Nb). Various other elements such as Si, C and so forth, may be included in the alloys of the invention while the relationships of Al and Nb (or elements substituted therefor) are maintained.

It is found that ductility and creep strength change inversely to each other over a very narrow range of aluminum content; thus, the aluminum content is very critical. The new alloys have relatively more niobium and less aluminum than alloys previously known. While increased niobium content is beneficial for creep strength and ductility, as a heavy element it is disadvantageous for creep strength-to-density ratio. Thus, higher levels are to be avoided, while lower levels fail to impart the desired properties.

In an important embodiment of the invention, vanadium partially replaces niobium in the aforementioned alloys and thereby lowers density, while favorable high temperature properties are retained. This effect does not appear possible with other elements. It is further discovered that the use of vanadium sustains or increases low temperature ductility, thereby ensuring fabricability while lowering density, again in contrast to other elements. Presently, it appears that up to four atomic percent niobium may be replaced by vanadium. Any amount of vanadium will provide some advantage but at least one atomic percent is preferred and two atomic percent is more preferred. Thus, an exemplary alloy of the invention will have an atomic percent composition of 24–26 aluminum, 10 niobium, 2 vanadium, balance titanium (nominally Ti-14Al-24NB-IV by weight percent). Additional elements such as Si, C, Bi, and so forth may be present in these alloys as desired to impart other characteristics.

Heat treatment is found to be very important. To obtain a desired balance of tensile strength, ductility, and creep strength, it is necessary to heat treat or forge the alloys in a manner which achieves a fine Widmanstatten structure. This is accomplished preferably in our alloy Ti-24Al-9Nb-2V by heating above the beta transus and then cooling at a controlled moderate rate, e.g., 4° C./sec. Solutioning and cooling is best followed by aging in the 700°–900° C. range.

The alloys of our invention have ductilities which make them usable in an engineering sense. They have strength to density ratios equalling or exceeding currently used nickel alloys and they are capable of being processed by conventional metalworking processes now in use for titanium. Thus, they represent a significant advance.

The foregoing and other objects, features and advantages of the present invention will become more apparent from the following description of preferred embodiments and accompanying drawings.

DESCRIPTION OF THE PREFERRED EMBODIMENT

Figure 1:
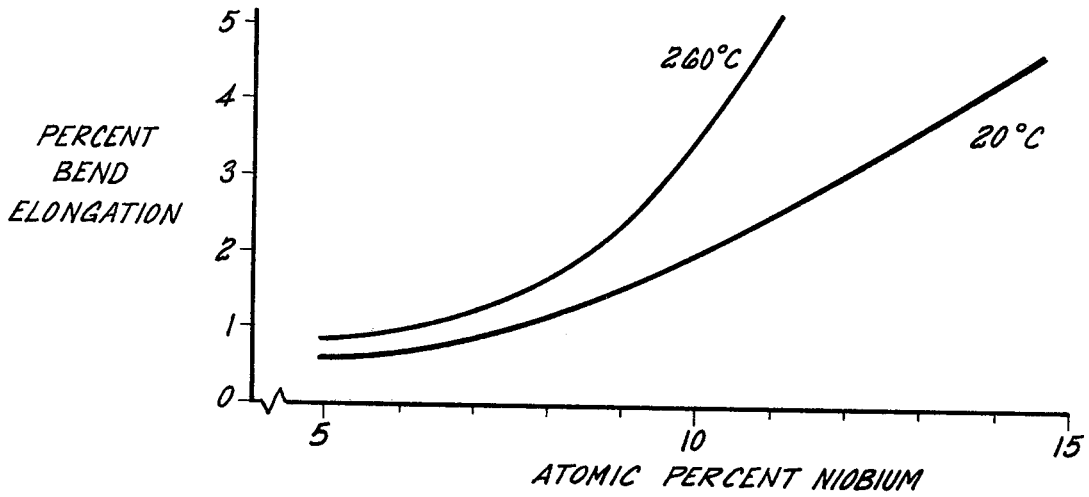
FIG. 1 shows the effect of niobium content on the ductility of Ti-Al-Nb alloys having 5–15 atomic percent aluminum.

The preferred embodiment herein is described in terms of atomic percents (a/o) of elements as this is the manner in which it was conceived and is most intelligently understood. But, for convenience of searchers of patent art, the invention is frequently stated in nominal weight percent (w/o). Those skilled in the art will recognize the limitations on stating the invention by weight percent. But, they also will readily convert from atomic percents to exact weight percents for particular embodiment alloys. As a casual aid, some titanium alloy weight and atomic equivalents are presented in Table 1.

In an extensive and continuing research program many titanium aluminum alloys of the $Ti_3Al$ type were evaluated. Basically, these were grouped as follows:

A. Single Phase and Interaction Studies:
   1. single element additions, such as Ta, W and Group IIA periodic table elements;
   2. two-element interactions, such as Ti-Al-Nb-Ga, etc.;
   3. effects of other elements such as Hf, C, Zr-Si, etc.

B. Alpha two plus Beta Systems: Ti-Al-Nb;

C. Ordered Mixed Hexagonal and Cubic Systems:

$$\begin{pmatrix} \text{Ti} \\ \text{Zr} \\ \text{Y} \end{pmatrix}_3 \begin{pmatrix} \text{Al} \\ \text{Ga} \\ \text{Sn} \end{pmatrix}_1$$

These alloys were melted and cast as small 50 gm melts; the structure, hardness, and mechanical bend properties were evaluated in the cast, heat treated, and forged condition; preferred alloys were scaled up to 1–2 kg castings and evaluated after hot isostatic pressing and forging by using metallography and creep and tensile tests; more preferred alloys from the second test series were further scaled up to 10 kg castings and evaluated again.

TABLE 1

| Alloy Equivalents | | | | | | | |
|---|---|---|---|---|---|---|---|
| Weight Percent | | | | Atomic Percent | | | |
| Ti | Al | Nb | V | Ti | Al | Nb | V |
| Ti | 15.7 | | | Ti | 25 | ($Ti_3Al$) | |
| Ti | 10 | 15 | | Ti | 17.7 | 7.7 | |
| Ti | 14 | 24 | | Ti | 24 | 12 | |
| Ti | 14 | 25 | | Ti | 25 | 13 | |
| Ti | 14.4 | 17.9 | 2.2 | Ti | 25 | 9 | 2 |

TABLE 1-continued

| Alloy Equivalents | | | | | | | |
|---|---|---|---|---|---|---|---|
| Weight Percent | | | | Atomic Percent | | | |
| Ti | Al | Nb | V | Ti | Al | Nb | V |
| Ti | 14 | 21 | 2 | Ti | 24 | 10.8 | 1.9 |
| Ti | 14 | 21 | 4.5 | Ti | 24.8 | 10.8 | 4.2 |
| Ti | 15 | 17.5 | | Ti | 26 | 8.8 | |
| Ti | 17.5 | 20 | | Ti | 30 | 10 | |
| Ti | 16 | 19 | | Ti | 28.3 | 9.4 | |
| Ti | 15 | 17 | | Ti | 26.6 | 9 | |
| Ti | 14 | 16 | | Ti | 24 | 8 | |
| Ti | 13 | 15 | | Ti | 22.5 | 7.5 | |
| Ti | 12 | 14 | | Ti | 21 | 7 | |

The results were compared in large part to the base alloy $Ti_3Al$ (Ti-14 Al by weight percent). It was found that single element additions such as Sc, Cu, Ni, Ge, Ag, Bi, Sb, Fe, W, Ta, Zr, from 1–14 atomic percent (0.04–27 weight percent) generally increased hardness, and in some instances, resistance to tensile cracking, but did not provide other important benefits, e.g., low temperature ductility was essentially lacking.

The two-element interactions indicated some promising trends in increased ductility particularly for niobium, and this improvement was carried over into the most promising alpha two plus beta system, described below.

For the interstitial interaction elements, such as Hf, C, and Zr-Si, adverse precipitation was noted when solubility limits were exceeded. It was evident from the outset and confirmed that elements such as these would be potentially useful within other major compositions, rather than being major constituents themselves.

Alloys in the ordered mixed Hexagonal and Cubic Systems had some attractive as-cast properties, but they tended on the whole to recrystallize and lose properties when subjected to a typical homogenization heat treatment.

The alloys of the alpha two plus beta system showed the best results. Combination of titanium, aluminum, and niobium were extensively evaluated, both as alloys with only the three elements and as alloys with the presence of one or more other elements including Ga, Ni, Pd, Cu, V, Sn, Hf, W, Mo, Fe, and Ta. Of these other elements there was little especial benefit shown, except for V, as detailed further below. In bend tests, it was found that ductility of Ti-Al-Nb containing alloys at temperatures from 20°–650° C. was increased when Nb was increased from 5 to 15 atomic percent, as shown in FIG. 1; the effect was greater at higher temperature. But, since niobium is a heavy atom, the increase in alloy weight or density is disproportionately greater than the change in atomic percentage. Conceptually, it is desirable to maintain the density of new titanium alloys in the general range of existing titanium alloys. In Ti-Al-Nb, this creates an aim of maintaining around 12 atomic percent Nb, and avoiding atomic percentages greater than about 16. As it happens, the test data are instructive in a a fashion consistent with this aim, as discussed below.

Tensile testing at room temperature and creep rupture life measurement at 650° C./380 MPa were very revealing of the sensitivity of properties to Al and Nb, compared to that appreciated heretofore. Table 2 shows some selected test data for alloys with various Al and Nb contents. (In a few of the alloys, vanadium was substituted for Nb and this is discussed below.) All test pieces were beta annealed, i.e., solutioned with air cooling after forging.

TABLE 2

Properties of Ti—Al—Nb alloys. Percent tensile elongation at room temperature is shown in parentheses. The other number is creep life in hours for a stress of 380 MPa at 650° C.

| | Atomic % Al | | | | |
|---|---|---|---|---|---|
| Atomic % Nb | 22 | 24 | 25 | 26 | 27 |
| 5 | 0.3 (0.3) | | | | |
| 9 | | | 0.8 (140)[a] | | |
| 9.5 | | 0.2 (20)[a] | | | |
| 10 | 3.0 (3.8) | 1.2 (30) | 0.8 (128) | | |
| 10.5 | | | | | 0.5 (15) |
| 11 | | 4.0 (20) 3.0 (65)[b] | | 1.5 (80)[c] | |
| 12 | | | | 1.4 (143) | |
| 13 | | | | | 1.0 (21) |
| 15 | | | 3.0 (130) | | |

Legend
[a]Ti—Al—(Nb + V)
[b]Ti—Al—Nb—Si
[c]25.5% Al

The previously-mentioned role of Nb in increasing bend ductility was confirmed in the tensile testing. It was also seen that creep life was relatively insensitive to Nb content over the range tested. Most of the data has been extracted and presented in FIGS. 2, 3 and 4 and to better illustrate the criticality of composition.

Figure 2:
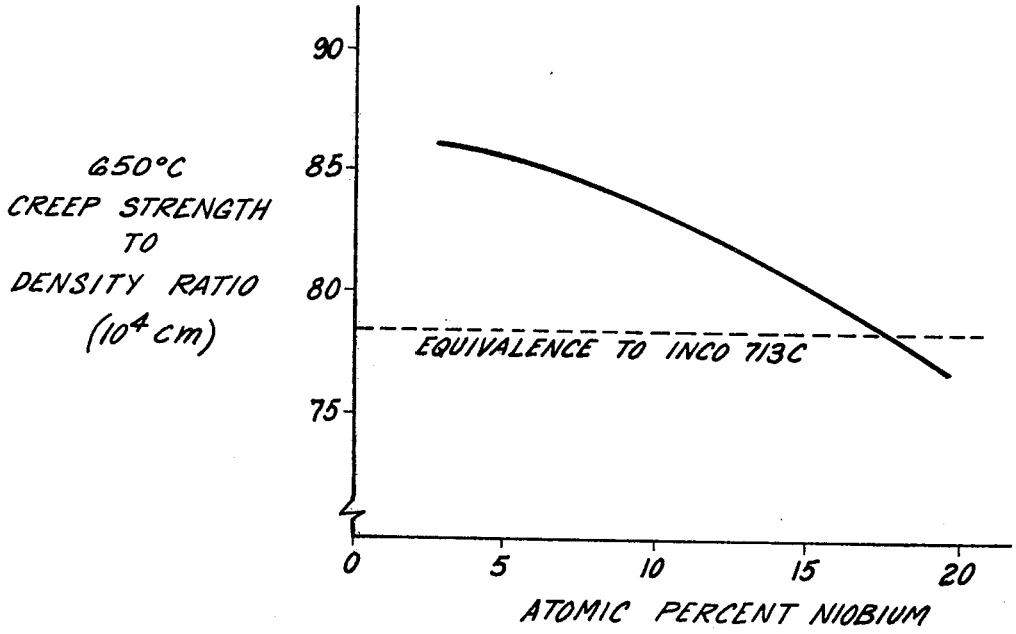
FIG. 2 shows the trend of creep strength to density ratio for Ti-25/26% Al alloys of various Nb contents, based on 100 hours life at 650° C.

FIG. 2 shows the trend of creep strength to density ratio of Ti-Al-Nb alloys having nominally 25–26% Al. Also shown is the minimum creep strength to density ratio for INCO 713C (Ni-13.5 Cr-0.9 Ti-6 Al-4.5 Mo-0.14 C-2.1 (Cb+Ta), 0.010 B, 0.08 Zr, by weight). All data are for the stress which yields 100 hours life at 650° C. It is evident that the increased density caused by higher Nb contents is unaccompanied by a commensurate increase in creep life. Therefore, alloys having more than 16–17% Nb do not outperform INCO 713C. and are not of particular interest in the present context, although they may be useful in other circumstances. The lower limit for Nb is treated below.

Figure 3:
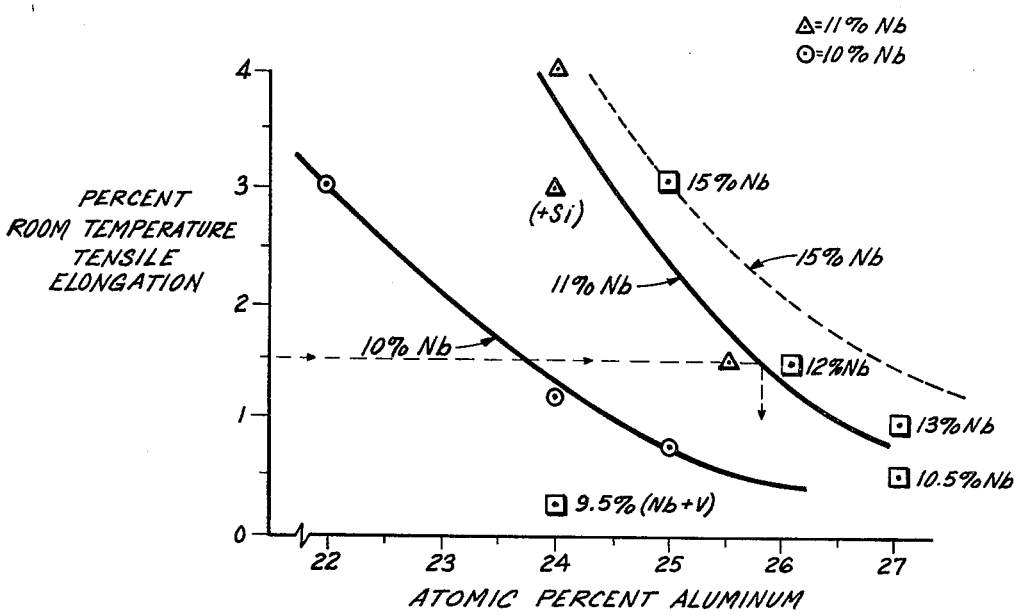
FIG. 3 shows the effect of aluminum content on room temperature tensile elongation of Ti-Al-Nb alloys having various atomic percents of Nb.

FIG. 3 shows quite dramatically the effect of aluminum. Ductility falls very sharply as aluminum content is increased from 22 to 27% in alloys with various Nb contents. And it is seen that less Al is tolerable in alloys having lower Nb contents. It would accordingly appear desirable to hold to a low aluminum content, but for the data in FIG. 3. There it is seen that higher aluminum contents are necessary for increased creep life. Consequently, it is necessary to balance the two conflicting considerations to obtain useful alloys.

Figure 4:
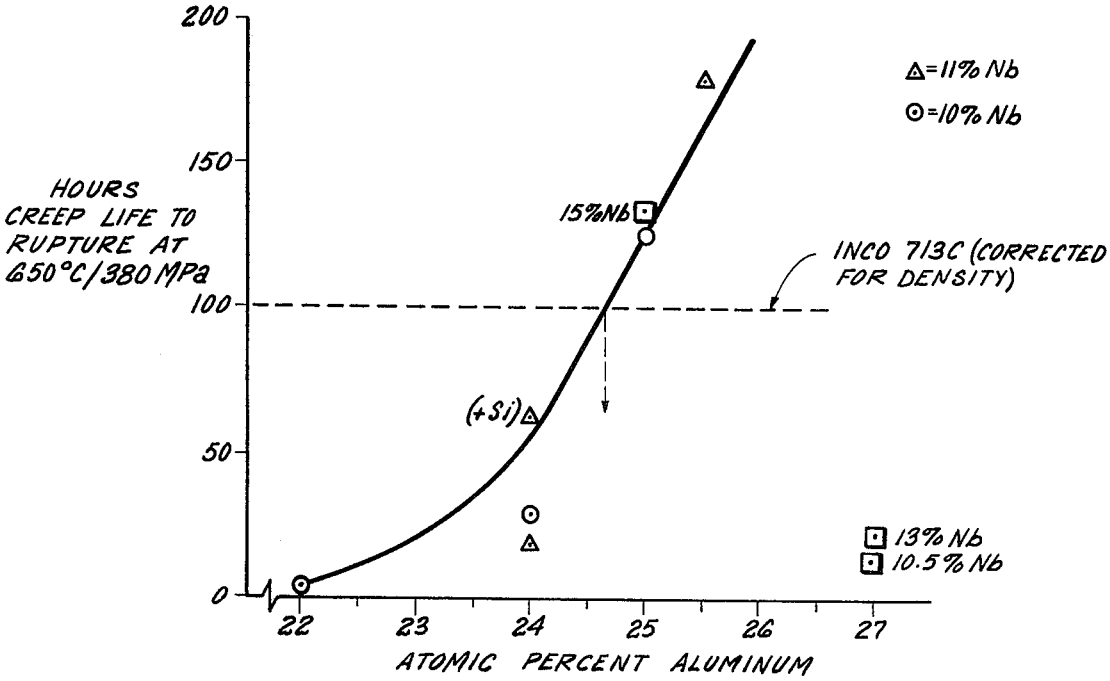
FIG. 4 shows the effect of aluminum content on the creep life of Ti-Al-Nb alloys having various atomic percents of Nb.

Table 3 provides our resolution of the necessary balancing. To obtain ductility above a nominal 1.5% tensile elongation criterion, according to FIG. 3, the aluminum content must be less than about the values shown as the upper limit in Table 3. Values for a lesser 1% elongation criterion are about one-half atomic percent higher, as also shown in the Table. Similarly, from FIG. 4, lower limits for Al may be established. Shown in FIG. 4 is the minimum creep life for INCO 713C nickel alloy on a density corrected basis, e.g., the test stress is increased on the INCO 713C in the ratio of the densities of INCO 713C to Ti-Al-Nb alloys: about 7.9/4.7=1.7. It is seen that the INCO 713C life is about 100 hours. Thus, to meet this criterion, Ti-Al-Nb alloys need have an aluminum content of about 24–24.5% or greater. There is not a great distinction among the different Nb contents over the 10–15% range insofar as the lower creep-based limit is concerned. In passing, it might be noted that FIG. 4 would appear to indicate that creep life peaks at about 26% Al, based on the two data points at 27% Al. There are other data for aluminum contents at 28–30% which are not presented here, showing higher creep lives up to 400–800 hours, and therefore 27% Al data should be discounted pending further investigation. Of course, as will not be surprising in the light of our discussion here, the alloys having 27–30% Al are all very brittle and therefore not useful in the present context.

TABLE 3

Percent Al in Ti—Al—Nb Alloys of various Nb contents, to produce useful properties

| I. ATOMIC PERCENT NIOBIUM | 10 | 11–13 | 14–16 |
|---|---|---|---|
| A. Upper Limit (1% El) | 24 | 26.5 | 27.5 |
| B. Upper Limit (1.5% El) | 23.5 | 26 | 27 |
| C. Lower Limit | 24.7 | 24.7 | 24.7 |
| D. Mean Ratio (Al/Nb) | 2.4 | 2.13 | 1.73 |

| II. NOMINAL WEIGHT PERCENT NIOBIUM | 19.6 | 24 | 28.5 |
|---|---|---|---|
| A. Upper Limit (1% El) | 13.7 | 15 | 15.2 |
| B. Upper Limit (1.5% El) | 13.4 | 14.7 | 15 |
| C. Lower Limit | 13.7 | 13.6 | 13.2 |
| D. Mean Ratio (Nb/Al) | 1.43 | 1.67 | 2.0 |

Notes
[a]Lower limit is determined by density-corrected creep strength compared to INCO 713C alloy.
[b]Upper limit is dependent on % Elongation desired, as shown in parentheses.

Figure 5:
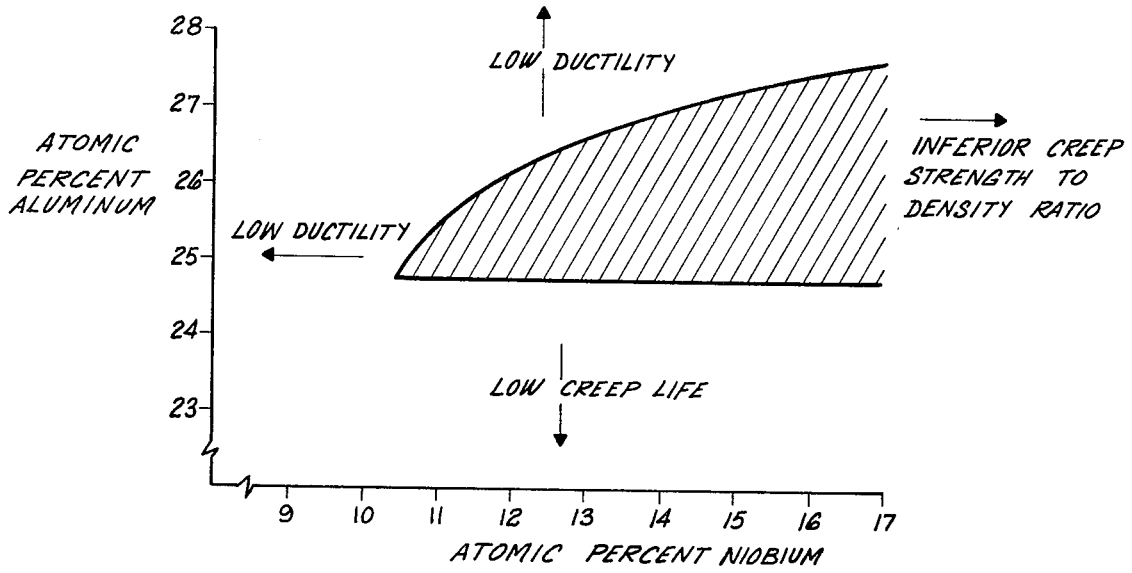
FIG. 5 shows the ranges of aluminum and niobium contents which produce useful properties in alloys comprised of Ti-Al-Nb based on criteria of 1.5% tensile elongation and density connected creep strength equal to INCO 713C nickel alloy.

Within the context of the data shown in FIGS. 3 and 5, those in the higher Nb content are preferred, in part because they are less sensitive to aluminum variations. Our preferred alloys have therefore Nb contents of 12–15%, and Al contents of 24.5–26%. Our presently most preferred alloy is Ti-25.5 Al-13 Nb. (In weight percents our broadest alloys are nominally Ti-13/15 Al-19.5/30 Nb; our preferred alloys are Ti-13.5/15 Al-23/28 Nb; and our most preferred alloy is Ti-14 Al-25 Nb.)

Examining Table 3, it can be seen that there is an inherent conflict in the data for 10% Nb. The percent Al needed for creep strength is greater than that which allows adequate ductility. Thus, useful alloys must have somewhat more than 10% Nb, since from FIG. 3 and Table 3 it is evident that there is a substantial gain by increasing Nb to 11%. Consequently, referring back to the prior discussion of FIG. 2 as well, it may be said that Nb must be greater than 10–11% and is preferably less than 16–17%.

FIG. 5 is a plot of the data in Table 3 for the 1.5% room temperature tensile elongation and INCO 713C creep strength criteria and summarizes the useful ranges of the invention according to this criterion. Of course, if somewhat differing criteria were taken for creep life and room temperature ductility, the permissible compositions would change somewhat.

Figure 6:
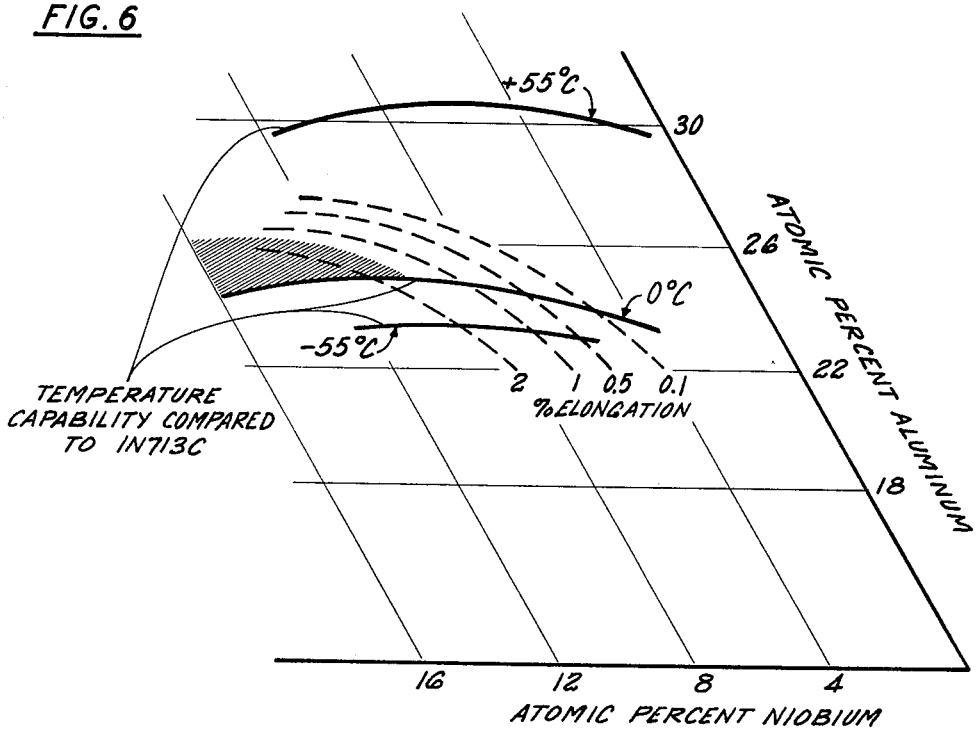
FIG. 6 shows a portion of a ternary Ti-Al-Nb composition diagram with creep strength and ductility isobars superimposed, together with the nominal composition ranges of the new alloys.

The interrelated effects of composition, room temperature ductility, and creep strength are displayed in FIG. 6. Shown is a segment of a ternary composition diagram having superimposed solid line isobars showing creep strength in terms of the temperature change from 650° C. which can be sustained by a particular composition alloy when it yields the same life as INCO 713C tested at 650° C./380 MPa with correction for density. Also superimposed are dashed line isobars showing the room temperature ductilities of the alloys. The shaded area is approximately that of the alloys of critical and desired composition, presented in Table 3.

Table 3 also defines the nominal ratios between Nb and Al which we have discovered to be required, in atomic and weight terms. It is seen that the atomic ratio declines as Nb content rises. The weight ratio is seen to rise with Nb content. In both instances, the ratios are presented on a nominal mean basis, but as the Al compositional ranges are narrow, the exact ratio range for a given Nb content alloy does not vary much.

We mention herein at several points that other elements may be included within our inventive compositions. Basically, we allude to the additions of small quantities, e.g., less than 1% C or Si, in replacement of titanium. However, we also consider that there might be substitution of limited quantities of other elements for Al and Nb which nonetheless would still maintain the altered alloys within the spirit and scope of our invention. Within this thought, we would consider to be, for instance, the substitution of Mo or W for a portion of Nb, or the substitution of Sn or In for a portion of Al.

As mentioned in the Background, the prior disclosures of Winter and McAndrew et al. are relevant to the invention and some further comment seems appropriate. Our alloy compositions follow a distinctly different path from those of Winter, if they are superimposed on the ternary phase diagram of FIG. 1 of the Winter U.S. Pat. No. 3,411,901. It will be seen that our alloys fall generally along Winter's lines connecting $Ti_3Al$ with $Nb_3Al$ and $Nb_2Al$. Thus, they have higher Nb contents and exhibit a different trend of composition than Winter's alloys which lie along the $TiNbAl_3$-$NbAl_3$-Ti axis.

With respect to McAndrews et al: their compositions approached but did not reveal our alloys. They also concluded that prospects for commercial (engineering) utilization of their alloys were not good and further development was inadvisable. As with Winter, the McAndrews' alloys did not have the proper ratio of Nb and Al. McAndrews tended to change Nb content inversely with change in Al, whereas we change directly. For example, taking the prime alloys, by weight percent Ti-13Al-25Cb-5Hf-0.1C and Ti-15Al-22.5Cb-1Sn (by atomic percent Ti-24.4Al-13.6Cb-1.4Hf-0.4C and Ti-26.6Al-11.6Cb-0.4Sn), it is seen that in the first the Cb/Al weight ratio is 1.9 and in the second 1.5, or decreasing ratio with increasing Al. Our alloys have increasing ratio (from 1.4 to 2.0) with increasing Al, and further we undertake same at a different proportional rate.

If one examines our Table 3 and FIG. 5, and plots thereon the alloys said to be most promising by McAndrews et al., it will be seen that they fall outside the limits that we now define as necessary for adequate properties. Thus, it might be said that McAndrews bracketed our invention, but did not discover it due to the sharp criticality of composition.

At the time we did the initial alloy studies, we were not aware of McAndrews et al. work. Upon becoming aware, we fabricated some alloys taught by McAndrews and sought to test them. We cast the alloy Ti-24.8Al-10.8Nb-0.5Zr-0.4Sn-0.8C (by weight Ti-14Al-21Nb-1Zr-1Sn-0.02C). When this alloy was hammer forged into a 1250° C. ingot bar in accordance with our practice with the other alloys, the ingot disintegrated thereby evidencing lack of ductility. Thereupon, we took some of the same alloy and diluted it by mixing it with an equal weight of Ti-24Al-11Nb, essentially having the effect of cutting the Zr, Sn, and C contents in half. This alloy could be forged and was tested. We likewise made other alloys containing 13.5Al and 21Nb by weight, with additions variously of 2Zr, 2Hf, 2Zr+1Sn=0.15Si, 0.2C, 5Hf, and 5Hf+0.2C. (These alloys essentially contained atomic amounts of Al between 24 and 24.8 and about 11Nb.) The data are shown in Table 4. The properties of the alloys, after 1200° C. (1 hour) air cool heat treatment, showed that the ductility was marginal-to-good, but creep rupture strength did not meet our goal of comparability to INCO 713C alloy. Thus, this investigation confirmed that the new alloys are substantially better than those of the prior art, whether the elemental additions cited by McAndrews et al. were included or not.

Many other elemental additions were made in the Ti-Al-Nb system, and the most noticeable effect we have discovered is that for vanadium. Substitution of vanadium for niobium in our above-disclosed Ti-Al-Nb alloys is found to be uniquely useful and advantageous. Vanadium is light and lowers density, while mechanical properties are maintained. There is also a cost advantage. In one test, the alloy Ti-25Al-8Nb-1V was found to have poor room temperature properties; this can be attributed to the Nb+V content being less than the lower limit for Nb, as discussed above. Ti-24Al-9Nb-1V had better properties, but creep strength was considered inadequate. The alloy Ti-25Al-9Nb-2V was found to have properties comparable to Ti-25Al-11Nb. The above Ti-Al-Nb-V alloys are present in the data of Table 2, and FIGS. 3 and 4, and it can be seen that the properties of Ti-Al-(Nb+V) alloys are consistent with the properties of those with Nb alone. Thus, it is discovered that V can be atomically substituted for Nb to produce mechanical properties in alloys containing Ti-Al-Nb which are comparable to those having Nb alone.

TABLE 4

Properties of Ti-24Al-11Nb Alloys with Additions

| Alloy Composition - Atomic % | Percent Tensile Elongation at Room Temperature | Rupture Life at 650° C./380MPa |
|---|---|---|
| Ti-24.2Al-11Nb-.5Hf | 0.15 | 10.5 |
| Ti-24Al-11.1Nb-1Zr | 1.2 | 9.7 |
| Ti-24.2Al-11Nb-1Zr-.5Sn-.5Si | 0.85 | 8.2 |
| Ti-23.7Al-10.9Nb-.9C | 1.3 | 9.2 |
| Ti-24.8Al-11.4Nb-1.4Hf | 0.68 | 0.7 |
| Ti-24.5Al-11.3Nb-1.5Hf-.9C | 1.0 | 20.3 |
| Ti-24Al-9Nb-1V | 0.15 | 19.8 |
| Ti-24Al-11Nb-.3La | 1.0 | 6.5 |

It further may be inferred, that as Nb content rises, the amount of Nb which may be replaced with V will also rise. Presently, it would appear that a Ti-25Al-15Nb alloy might have up to 4% V substituted for Nb, to result in the alloy Ti-25Al-11Nb-4V. We should prefer to put at least 1 atomic percent V in an alloy to obtain a consequential effect, though any amount of V substituted for Nb would appear to offer an advantage, however slight.

In alloys of the Ti-Al-Nb and Ti-Al-Nb-V types mentioned above, other elements may also be included to enhance certain properties for particular applications. For example, various elemental additions revealed in the prior art, such as Si, Zr, Hf, Sn and the like may be revealed to have analogous advantage in our new alloys upon further work. However, in our work so far we have not yet uncovered any particular advantage or requirement for such additions or substitutions.

In work involving making larger heats of the alloys of the above types, it was found that casting is preferably followed by hot isostatic pressing and then forging. Alternatively, forging stock has been made by hot consolidation of powders. Of course, as with conventional titanium alloys, care must be taken to avoid contamination, and especially, oxygen and other unwanted interstitial elements during processing. On the whole, conventional fabrication processes may be used. Forging is conducted conventionally or isothermally at billet temperatures in the 1000°-1200° C. range. Conventional machining techniques may be used, so long as care is taken to avoid undue residual surface stresses.

During our development work it became clear that the properties of our alloys were quite dependent on microstructure. While many of the structural and kinetic details of transformation in alloys of the $Ti_3Al$ type are imperfectly known, generally the transformations appear similar to those observed in conventional alpha-beta titanium alloys.

Isothermally forged Ti-25-Al-9Nb-2V alloy was used to evaluate heat treatment and some test data is shown in Table 5. This alloy has a beta transus of about 1125° C. As represented by the heat treatments labeled A, B, and C, solutioning above the beta transus followed by aging results in an increase in tensile strength and ductility and a decrease in creep rupture life compared to the baseline, as aging temperature is increased. Solutioning and cooling from below the beta transus produces both low ductility and low creep life, as D exemplifies. Similarly, poor results are produced by heat treatment E, wherein the alloy is cooled very rapidly by salt quenching: very high strength coupled with zero ductility and poor creep life. Thus, it is concluded that solutioning or forging above the beta transus followed by aging between 700°-900° C. is the preferred heat treatment; the better properties are associated with a fine Widmanstatten structure as discussed further below.

TABLE 5

Heat Treatment of Ti-25Al-9Nb-2V Alloys

| Heat Treatment (°C./hr/cooling) | RT UTS (MPa) | RT Elongation (%) | 650° C./380 MPa Creep Life (Hours) |
|---|---|---|---|
| Baseline: As Forged | 542 | 0.5 | 16 |
| A. 1150/1/AC | 957 | 0.5 | 72 |
| B. 1150/1/AC + 760/1/AC | 852 | 1.4 | 66 |
| C. 1150/1/AC + 815/1/AC | 734 | 2.3 | 39 |
| D. 1093/1/AC | 644 | 0.25 | 44 |
| E. 1150/1/SQ at 1000° C./5 min/AC | 1440 | 0 | 11 |

Legend
AC = air cool
SQ = salt quench
RT = room temperature

Very rapid quenching of our new alloys from the beta phase field is not a practical heat treatment method as it results in strong, rather brittle and potentially cracked structures; further, the resultant structures may be unstable on tempering. Structures formed by less severe cooling rates are therefore of more interest from a practical standpoint. There is a natural dependence on initial structure quite like that in conventional titanium alloys. If a conventional alpha-beta alloy is worked in the two-phase region, an equiaxed mixture of the two phases is formed and the beta phase may transform on subsequent cooling. Similar structures can be formed in our alpha two plus beta alloys. Heat treatment or forging above the beta transus will result in acicular structures. In alpha two type alloys, these may range from a virtually unresolvable structure after quenching, to a coarse colony (groups or packets of plates with similar orientation) structure. Intermediate cooling rates produce a desired Widmanstatten arrangement of much smaller alpha two plates.

In additional studies on the alloy Ti-24Al-11Nb, we investigated the effect of cooling rate from the beta transus, with the following properties:

| Cooling Rate (°C./sec) | 0.2% Yield Strength at Room Temperature (MPa) | Tensile Percent Elongation at Room Temperature |
|---|---|---|
| 14 | 1170 | 1.4 |
| 4 | 760 | 4.9 |
| 1 | 450 | 1.8 |

Figure 7:
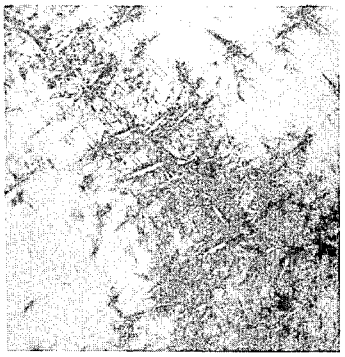
FIG. 7 shows microstructures in Ti-24Al-11Nb alloy produced by different cooling rates from above the beta transus.

There is a very marked dependence of ductility on cooling rate and therefore the intermediate cooling rate is preferred, even though there is some sacrifice in tensile strength. Microstructural studies reveal substantial differences between the product produced by the different cooling rates. Rapid cooling results in a partially transformed structure with barely resolvable martensitic structure, as shown in FIG. 7(*a*). Excessively slow cooling results in an acicular colony structure, shown in FIG. 7(*c*). The preferred intermediate cooling rate produces a fine Widmanstatten structure, wherein acicular alpha two structures of about 50 by 5 micrometers are dominant in a beta field. This is shown in FIG. 7(*b*). Consequently, it becomes an aim to achieve the preferred fine Widmanstatten structure. The conditions necessary to achieve this will depend on the size of the article, and it will be appreciated the foregoing data are representative of our particular configurations. Generally, we believe that cooling in air or the equivalent will be suitable for most small articles. (During all heat treatment, precautions should be taken to protect the alloys from contamination, similar to steps followed with conventional alloys of titanium.)

We have discovered a further alternative method of achieving the desired microstructure in some articles of our alloys. This comprises solutioning above the beta transus and then quenching in a molten salt bath maintained at about 750° C. Upon immersion into the bath, the article is held until equilibrium is attained, whereupon it may be removed and air cooled. The heat transfer characteristics of the salt bath will produce the desired result, however, some surface contamination will result and this must be removed subsequently.

Although this invention has been shown and described with respect to a preferred embodiment, it will be understood by those skilled in this art that various changes in form and detail thereof may be made without departing from the spirit and scope of the claimed invention.

Having thus described a typical embodiment of our invention, that which we claim as new and desire to secure by Letters Patent of the United States is:

1. A titanium aluminum alloy which may be cast and forged, having at least 1.5% tensile ductility at room temperature and good elevated temperature creep strength, consisting essentially by atomic percent of 25–27 Al, 12–16 Nb, balance Ti (nominally by weight, 13.5–15.3 Al, 23.4–30 Nb, balance Ti).

2. The alloy of claim 1 consisting essentially by atomic percent of 25–26 Al, 12–15 Nb, balance Ti (nominally 13.5–15 Al, 25–28 Nb, balance Ti).

3. The alloy of claim 1 consisting essentially by atomic percent of 25.5 Al, 13 Nb, balance Ti (nominally 14 Al, 25 Nb, balance Ti by weight).

4. The alloy of claim 1 wherein vanadium is substituted for Nb in atomic amounts of 1–4 percent.

5. The alloys of claims 1, 2, or 3 wherein vanadium is substituted for niobium in atomic amounts of up to 4 percent.

6. The alloy of claims 1, 2, or 3 heat treated first at a temperature above the beta transus, then cooled at a controlled rate, sufficient to produce a fine Widmanstatten structure similar to that shown in FIG. 7.

7. An alloy of claim 1 having between 1 and 4 atomic percent vanadium, heat treated by first solutioning at a temperature above the beta transus, then cooling sufficiently fast to produce a fine Widmanstatten microstructure similar to that shown in FIG. 7, and then aging at 700°–900° C. for 4–24 hours.

* * * * *